United States Patent [19]

Pacholok

[11] 3,960,373

[45] June 1, 1976

[54] SHUTTLE GUARD FOR SIGNATURE FEEDER

[75] Inventor: Jaroslaw Pacholok, Downers Grove, Ill.

[73] Assignee: Bell & Howell Company, Chicago, Ill.

[22] Filed: Jan. 15, 1975

[21] Appl. No.: 541,375

[52] U.S. Cl. ..... 271/10; 271/102; 271/131

[51] Int. Cl.[2] ..... B65H 3/12

[58] Field of Search..... 271/10, 99, 102, 131–144; 214/8.5 F; 74/614, 615; 187/98

[56] References Cited

UNITED STATES PATENTS

| | | | |
|---|---|---|---|
| 648,309 | 4/1900 | Spencer | 187/98 |
| 1,810,364 | 6/1931 | Marshall | 74/615 |
| 1,965,819 | 7/1934 | Allen | 271/131 |
| 2,908,496 | 10/1959 | Long | 271/132 |

FOREIGN PATENTS OR APPLICATIONS

| | | | |
|---|---|---|---|
| 799,339 | 11/1968 | Canada | 271/132 |

*Primary Examiner*—John J. Love
*Assistant Examiner*—Robert Saifer
*Attorney, Agent, or Firm*—Robert A. Walsh

[57] ABSTRACT

A signature feeding mechanism having a shuttle plate and an associated vacuum gripper for feeding the bottom signature from a stack in a supply magazine into the bite of pinch rolls which advance successive signature pieces to a transport system for advance to a label applicator, or the like, and having a guard plate for bridging exposed portions of the gap between the leading edge of the shuttle plate and the signature receiving end of the associated transport conveyor floor so as to prevent possible damage to, or interference with the operation of, the feeding mechanism, by the presence of a foreign object in the gap, and possible injury to an operator through careless insertion of the fingers in the same.

7 Claims, 4 Drawing Figures

FIG. 1
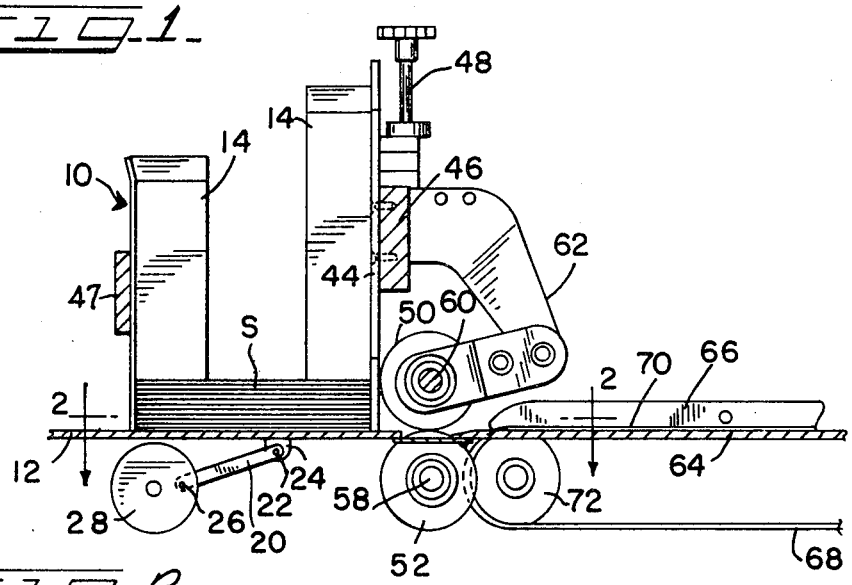
FIG. 2
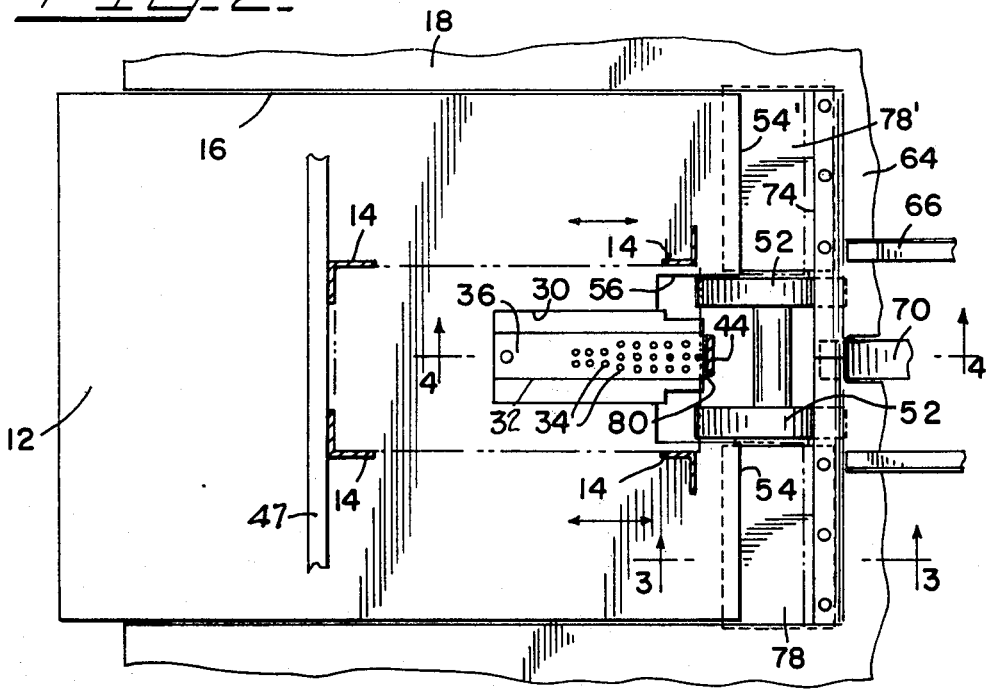
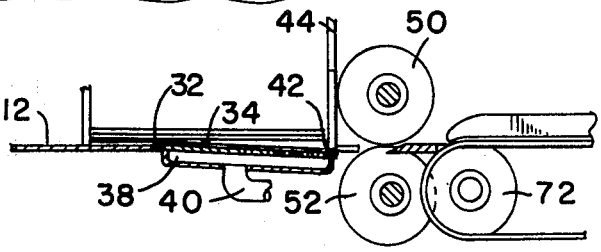
FIG. 4
FIG. 3
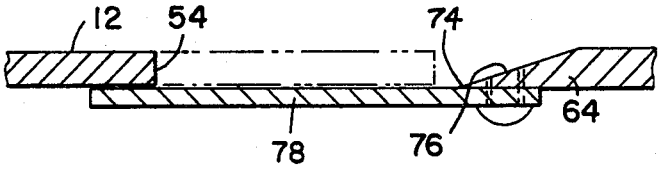

SHUTTLE GUARD FOR SIGNATURE FEEDER

This invention relates to apparatus for feeding signatures, or similar media, from a supply magazine, for advance, one by one, on a transport system, and is more particularly concerned with improvements in a shuttle feed mechanism which is adapted to reduce the risk of injury in the operation of the apparatus which, otherwise, could result from careless or improper use of the apparatus.

Various arrangements have been developed for feeding signature pieces of various kinds from a stack in a magazine, or similar area, and for advancing successive signatures on a transport system to a further processing area, or the like. One such apparatus employs a mechanism at the bottom of the stack or magazine which removes successive signatures from the bottom of the stack by means of mechanism including a reciprocating shuttle with associated means for gripping the bottommost signature in the stack and feeding the same to a transport system. A signature feeding mechanism of this type, which employs a reciprocating shuttle plate for feeding signatures from the bottom of the stack, has been found adaptable for high speed labeling operations where the signatures are envelopes, post cards, catalogues, fliers, newspapers, magazines, or the like, which are advanced one-by-one on a transport system to an address label applying mechanism. In the use of labeling machines having signature feeders of this type the signature feeder is arranged at the trailing or signature receiving end of a transport system which advances the individual signature pieces to the label applying area. A gap results between the leading end of the shuttle plate and the trailing end or edge of the transport conveyor system which accommodates the reciprocating movement of the leading end of the shuttle plate. This gap is of relatively small dimensions and in the normal and proper operation of the apparatus presents no problem but it has been recognized as a possible hazard which could result in damage with improper or careless use. The shuttle plate has a limited reciprocating movement, leaving an opening of very small width when the shuttle plate is fully extended during the signature feeding movement and an opening of substantially larger width when the plate is in fully retracted position. Any signature jamming at the opening, which may occur due to a torn or wrinkled signature or the like, with the shuttle plate in any position, is readily cleared, since normal signature pieces are relatively thin and easily torn. However, experience with this type apparatus has prompted a study of this area from a safety standpoint which has indicated the desirability of bridging this gap in a manner which will afford maximum safety in operation and substantially reduce or effectively eliminate any risk of damage resulting when the apparatus is in use, either to the apparatus, or the operator who may disregard normal safety precautions or make improper use of the apparatus. It is a general object, therefore, to provide an improved signature feeding apparatus for labeling machines, or the like, which eliminates a hazard heretofore present in the use of prior apparatus of this type and reduces the risk of possible damage which could otherwise result from failure to exercise proper care in the use of the apparatus.

A more specific object of the invention is to provide an improved signature feeding apparatus of the type which employs a shuttle plate, with associated gripper means operating at the bottom of a stack of signatures, for feeding signatures, one by one, from the bottom of the stack to a transporting system wherein provision is made for bridging the gap between the leading end of the shuttle plate and the receiving end of the transporting mechanism, in the areas which are sufficiently accessible to enable foreign objects to lodge therein with resultant damage to the apparatus or injury to a careless operator who may reach into the opening, while the machine is running, in an attempt to retrieve something caught therein.

A still more specific object of the invention is to provide an improved signature feeding apparatus of the type having a stack of signatures on a support which includes a shuttle plate and associated gripper means for feeding the bottommost signature from the stack and delivering the signatures, one by one, to a forwarding conveyor mechanism which has the trailing end or edge of a floor forming plate serving as a signature support or guide spaced forwardly of the operating path of the shuttle plate so as to leave a gap between the leading end of the shuttle plate and the receiving end of the floor plate of the conveyor mechanism, which gap varies in width during operation of the shuttle plate and is very nearly closed when the shuttle plate reaches the end of its forward feeding movement, wherein a guard plate is provided which bridges the readily accessible portions of the gap and which is mounted so that the shuttle plate slides over the top surface and merely pushes aside anything dropped or otherwise positioned in the gap thereby preventing damage or injury which could otherwise occur.

A further object of the invention is to provide an improved signature feeding apparatus of the type which includes a bottom shuttle plate with signature gripping means operating in a generally horizontal path wherein readily accessible portions of the space between the leading end of the shuttle plate and the co-operating transporting mechanism, which includes a means for advancing the signatures, one by one, out of the bottom of the supply stack, are bridged by plate members fixed beneath a base or floor plate of the transporting mechanism and arranged with the edge confronting the leading edge of the shuttle plate tapered or otherwise configured so that any foreign object dropped onto or resting on the plate members may be pushed forward by the shuttle plate and caused to ride up over the tapered edge of the conveyor floor plate thereby minimizing the likelihood of damage to the apparatus or the object.

These and other objects and advantages of the invention will be apparent from a consideration of the signature feeding apparatus and a portion of the associated transport system which is shown by way of illustration in the accompanying drawings, wherein:

FIG. 1 is a longitudinal, vertical section, partially schematic and with parts omitted, showing a signature feeding apparatus and a portion of an associated transport system which embodies the principal features of the invention;

FIG. 2 is a plan view, taken on the line 2—2 of FIG. 1, with parts broken away or omitted, the view showing the shuttle plate mechanism which forms the floor of the supply magazine in a different position and also showing associated portions of a transport system;

FIG. 3 is a fragmentary sectional view, to an enlarged scale, the view being taken on line 3—3 of FIG. 2, showing the shuttle plate in retracted position; and FIG. 4 is a fragmentary sectional view, taken on the line 4—4 of FIG. 2, with the shuttle plate in fully extended position.

Referring to the drawings, there is illustrated a signature feeding mechanism which is particularly adapted for use in supplying mailing pieces, such as, cards, envelopes, advertising fliers, or the like, to a transport system for advance one-by-one to a label applying area. In the form of the mechanism shown a supply of the signatures or work pieces, for example, envelopes, indicated at S, is arranged in a stack in a magazine 10. The magazine 10 is formed above a shuttle plate 12 by means of upright corner post forming angle members 14 which are arranged according to the shape of the signatures S. The upright magazine defining members 14 are adjustably mounted, independently of the shuttle plate 12 which constitutes the bottom or floor of the magazine, in whole or in part, so as to enable the machine to handle signatures of different size, within predetermined limits. As shown in FIG. 2, the shuttle plate 12 is disposed in a horizontal plane in an opening or slot 16 in a support plate 18 which may form a part of the main frame of the label applying machine or other apparatus in which the signature feeder is employed.

The shuttle plate 12 is mounted for reciprocation in a horizontal path and driven by a crank rod 20 (FIG. 1) pivoted at one end at 22, on a depending bracket 24 and eccentrically pivoted at the other end, at 26, on a rotatably mounted disc drive member 28. At its forward edge or margin the shuttle plate 12 is provided with a recess 30 (FIG. 2) in which there is mounted an insert 32 with a plurality of apertures or air holes 34 in its top face 36 and a vacuum chamber formation 38 (FIG. 4) on its bottom face which has a conduit connection, indicated 40, to a vacuum line or other vacuum source. The insert 32 is set in the longitudinal center of the shuttle plate 12 and has its upper face 36 concave in cross section so that upon the application of vacuum through the insert 32 the center forward portion of the bottommost signature S in the supply stack will be drawn down sufficiently to pass under the bottom end 42 (FIG. 4) of a vertically disposed guard bar 44 which is mounted for vertical adjustment on a support forming cross frame bar or plate 46, with an adjusting screw mechanism being indicated at 48. The vertically disposed guard or guide bar 44 depends in the otherwise open discharge face, or side, of the magazine 10 and forms a gate through which the signatures exit the magazine. The bar 44 also serves to insure, when properly adjusted, that only the bottommost signature S will be removed by operation of the shuttle plate 12 so as to feed the signatures S one-by-one and in succession to a transport system. The cross frame bar 46 also serves as a support for adjustably clamping thereon the post angles 14 which form the forward portion of the magazine 10. The rearward post forming or corner forming angle members 14 are clamped in a similar manner on a frame cross bar 47.

The transport system includes two pairs of upper and lower pinch rolls 50 and 52 suitably mounted above and below the plane of advance of the signatures. The shuttle plate forward edge portions 54, 54′ extend on opposite sides of a widened portion 56 of the slot 30 which is of a width sufficient to clear the lower pinch rolls 50, 52, the latter having a relatively small axial spacing. The bottommost pair of pinch rolls 52 are rotatably mounted on a cross shaft 58 while the topmost pair of pinch rolls 50 are mounted on a cross shaft 60 which is supported on a bracket assembly 62, with pressure adjustment by means of a conventional screw actuated eccentric cam arrangement.

The floor plate 18 is extended at 64 to form the signature supporting floor of the transport system with cooperating adjustable angle members forming side guides 66 defining a guide path for advance of the signatures as they emerge from the bite of the pinch rolls 50, 52. A conveyor belt 68 having a top run 70 is carried on suitably supported, spaced end rollers 72, only one of which is illustrated. The top belt run 70 travels in a path slightly above the top surface of the floor plate 64 so as to advance signatures away from the pinch rolls 50, 52. The plate 64 is slotted to accommodate the pinch rolls 50, 52 and the conveyor belt assembly 68. The edge 74 of the floor plate 64, which is disposed in opposed relation to the edge portions 54, 54′ of the shuttle plate 12, is tapered, at 76, in an upward and forward direction, so as to insure that the advance of the signatures will not be obstructed as they exit the magazine 10 but will ride up on the ramp formed by the beveled edge 74.

The space allowed between the forward edge portions 54, 54′ of the shuttle plate 12 and the confronting portions of the edges 74 of the plate portion 64 provides a gap which opens and closes, or very nearly closes, with every reciprocation of the shuttle plate 12 during the signature feeding operation. Guard plates 78, 78′ are bolted or otherwise secured, along one margin, on the bottom margin of the plate portion 64, which guard plates extend laterally from a point adjacent the pinch roll opening 56 in the shuttle plate 12 to the outermost limits of the slot 16 in which the shuttle plate is mounted. The guard plates 78, 78′ have a dimension in the direction of advance of the signatures which is sufficient for the plates 78, 78′ to extend a short distance beneath the shuttle plate forward edge portions 54, 54′ when the shuttle plate 12 is fully retracted so as to bridge the gap between the edge portions 54, 54′ and the edge 74 on opposite sides of the pinch rolls 50, 52 and, by closing the gap, eliminate the risk of any foreign object becoming lodged in the space and interferring with the movement of the shuttle plate 12. The guard plates also materially reduce the risk of injury to a careless operator who might otherwise risk crushing his hand or fingers in attempting to remove a jam in the opening. The space between the pinch rolls 50, 52 is sufficiently small and sufficiently obstructed so as to pose little or no damage hazard, particularly, with the opening in this area between the forward edge 80 of the vacuum plate 36 and the edge 74 of the plate 64 being substantial when the shuttle plate 12 is in the forward position.

I claim:

1. A signature feeding apparatus comprising means forming a magazine for holding a stack of signature pieces, a shuttle plate mounted for reciprocation in the bottom of said magazine forming means and constituting the floor of said magazine, said shuttle plate having means for gripping the lowermost signature in the stack so as to advance the signatures one-by-one to a transport system, means forming a gate at the bottom of said magazine for passage of successive signatures, a signature transport system having a signature receiving end adjacent said gate and having means for advancing successive signatures through said gate, said transport system having floor forming means with the signature receiving end thereof spaced relative to the path traversed by the leading end of said shuttle plate so as to leave a gap when the shuttle plate retracts with portions thereof exposed, and means bridging said exposed portions of said gap so as to prevent any foreign object from lodging in said gap and minimizing the risk of damage to the machine or the object by movement of the shuttle plate.

2. A signature feeding apparatus as set forth in claim 1 wherein said means bridging said gap comprises one or more plate members secured in fixed position relative to said floor forming means and extending immediately beneath the path of the leading end of said shuttle plate.

3. A signature feeding apparatus as set forth in claim 1 wherein the floor forming means of said transport system comprises a floor member in the form of a plate having its trailing edge disposed in spaced opposed relation to the leading edge of said shuttle plate and wherein said means bridging said exposed portions of said gap comprises one or more guard plate members secured to the trailing end of said floor member and extending immediately beneath the path of travel of the leading end of said shuttle plate.

4. A signature feeding apparatus as set forth in claim 3 wherein said trailing edge of said floor member is tapered upwardly from a relatively thin edge portion and forwardly in the direction of advance of said shuttle plate so as to enable any foreign object lodged on said guard plate members to ride up on said tapered edge when urged forwardly by forward travel of said shuttle plate.

5. An apparatus for feeding envelopes, mailing pieces, or similar work pieces, from a supply stack to a transport system which includes a reciprocably mounted shuttle plate disposed below the bottom of the stack and having means to grip the bottommost work piece and to forward successive work pieces from said stack to said transport system, said shuttle plate having forward edge portions disposed in confronting relation with trailing edge portions of a signature support plate constituting adjoining portions of said transport system, said forward edge portions of said shuttle plate being spaced from said trailing edge portions of said signature support plate so as to leave a gap between said edge portions of varying dimensions during reciprocation of said shuttle plate, and guard plates bridging said gap which extend immediately beneath said edge portions and which close exposed portions of said gap during the reciprocation of said shuttle plate.

6. An apparatus as set forth in claim 5 wherein the edge portions of said signature support plate at the side of said gap are beveled so as to form a ramp over which an object is free to slide when moved against the same during advancing movement of said shuttle plate.

7. An apparatus as set forth in claim 5 wherein said apparatus comprises pinch rolls disposed in the transverse center of said gap for gripping successive work pieces and withdrawing said work pieces from the bottom of said stack, and wherein said guard plates extend laterally on opposite sides of said pinch rolls.

* * * * *